United States Patent [19]

Sugden

[11] Patent Number: 4,759,186

[45] **Date of Patent: * Jul. 26, 1988**

[54] SELF-POWERED ROTARY ACTUATOR UTILIZING ROTATION-GENERATED CENTRIFUGAL HEAD

[75] Inventor: Kenneth B. Sugden, Rockford, Ill.

[73] Assignee: Sundstrand Corporation, Rockford, Ill.

[ * ] Notice: The portion of the term of this patent subsequent to Jun. 28, 2005 has been disclaimed.

[21] Appl. No.: 813,498

[22] Filed: Dec. 26, 1985

[51] Int. Cl.[4] ..... F01C 9/00; F01B 13/00; F01B 15/04

[52] U.S. Cl. ..... 60/473; 91/416; 92/121

[58] Field of Search ..... 91/59, 210, 416; 92/55, 92/121, 124, 125; 60/325, 473, 475, 476

[56] References Cited

U.S. PATENT DOCUMENTS

| | | | |
|---|---|---|---|
| 2,249,671 | 7/1941 | Skowron | 210/119 |
| 2,881,338 | 4/1959 | Banning | 310/119 |
| 2,911,956 | 11/1959 | Smith, Jr. | 92/67 |
| 2,988,057 | 6/1961 | Litz | 91/167 R |
| 3,049,102 | 8/1962 | Reimer et al. | 92/85 R |
| 3,179,018 | 4/1965 | Rumsey | 92/28 |
| 3,198,089 | 8/1965 | McGay | 92/94 |
| 3,198,090 | 8/1965 | French | 92/121 |
| 3,279,329 | 10/1966 | Floer | 92/67 |
| 3,289,544 | 12/1966 | Daniels | 92/167 A |
| 3,318,201 | 5/1967 | Blake | 92/121 |
| 3,327,592 | 6/1967 | Wilkinson | 92/122 |
| 3,426,652 | 2/1969 | Blake | 92/27 |
| 3,444,789 | 5/1969 | Hansen | 92/121 |
| 3,665,835 | 5/1972 | Oates | 92/121 |
| 3,670,627 | 6/1972 | Valantin | 91/167 A |
| 3,732,786 | 5/1973 | Grosseau | 92/66 |
| 3,750,535 | 8/1973 | Higuchi | 92/121 |
| 4,345,509 | 8/1982 | Bridwell et al. | 92/78 |
| 4,414,854 | 11/1983 | Haeg | 73/847 |
| 4,492,150 | 1/1985 | Yates | 92/13.6 |

FOREIGN PATENT DOCUMENTS

| | | | |
|---|---|---|---|
| 3222982 | 12/1983 | Fed. Rep. of Germany | 92/121 |
| 393930 | 11/1965 | Switzerland | 92/121 |

*Primary Examiner*—Robert E. Garrett
*Assistant Examiner*—George Kapsalas
*Attorney, Agent, or Firm*—Wood, Dalton, Phillips, Mason & Rowe

[57] ABSTRACT

The hydraulic actuator (35) utilizes the centrifugal head developed in its pressure chambers (52,54) when the housing (44) rotates as a source of pressure. As actuator (35) rotates fluid exits outlet port (56) and passs through a servovalve (64) into chamber (54) to move vane (49) relative to the actuator (35). To move vane (49) in the other direction, fluid exits outlet port (58) and passes through the valve into chamber (52). This self-powered actuator has utility in systems requiring relative angular positioning between a pair of rotating elements such as a pair of voltage regulator rotors in a dual permanent magnet generator.

10 Claims, 2 Drawing Sheets

SELF-POWERED ROTARY ACTUATOR UTILIZING ROTATION-GENERATED CENTRIFUGAL HEAD

BACKGROUND OF THE INVENTION

1. Field of the Invention

This invention relates generally to an actuator and more particularly to a rotary hydraulic actuator which is self-powered.

2. Brief Description of the Prior Art

Rotary hydraulic actuators of the vane type having a shaft rotatable in response to rotary movement of the vane have been proposed generally to provide angular positioning of the shaft relative to a fixed reference. Examples of such an actuator are disclosed in Floer U.S. Pat. No. 3,279,329 and Higuchi U.S. Pat. No. 3,750,535.

The constructions disclosed in the above patents are suitable where absolute angular positioning is required. However, these actuators require a complex hydraulic system, including a pump, to control angular position. Furthermore, such constructions are not directly applicable to mechanical systems requiring relative angular positioning between a pair of loads. One such mechanical system is a dual permanent magnet generator (PMG). In a dual PMG the relative angular position of a pair of rotors is controlled to provide for voltage regulation. The rotors may be coaxial, or alternately, may be positioned in a side-by-side relationship.

Frister U.S. Pat. No. 3,713,015 shows a dual PMG wherein controlled axial movement is converted, by a helical gear, to angular motion to provide relative angular positioning between a pair of rotors. Though such a system should work well in theory, in practice, particularly in high speed generators, difficulty in effecting required voltage regulation may be encountered. In particular, loading of the rotor components due to centrifugal force and other operational factors may render it difficult to achieve relatively precise angular adjustment between the rotors. To the extent that precise adjustment is hindered, good control cannot be achieved.

The present invention is intended to overcome these and other problems associated with actuators.

SUMMARY OF THE INVENTION

It is an object of this invention to provide a hydraulic actuator which is self-powered. By providing a self-powered actuator a complex hydraulic system is not required resulting in savings in weight and cost while improving overall efficiency of the actuator.

A typical embodiment of the invention achieves the foregoing object in an actuator having a housing with means mounting the housing for rotation about an axis. A chamber is included within the housing and a movable divider therein divides the chamber into first and second variable volume compartments. An actuator element coupled to the divider to be moved thereby includes means for coupling the divider to a load. First and second inlets are included for the first and second compartments respectively. Similarly, first and second outlets are included for the first and second compartments respectively. Means are included for selectively connecting the first inlet to the second outlet and the second inlet to the first outlet, whereby fluid in the compartments develops a pressure head through centrifugal force to power the actuator when the housing is rotated about the axis.

The resulting construction eliminates the necessity of various hydraulic components which might otherwise be required such as a pump, numerous valves, an accumulator and the associated piping. Thus, the system is lighter in weight and smaller in size, as well as less expensive.

In one embodiment of the invention, the divider is a vane mounted in the chamber for rotation therein about the axis.

In another embodiment of the invention, a second actuator element is coupled to the housing to be moved thereby and includes means for coupling the housing to a second load. In a dual permanent magnet generator having loads in the form of a pair of rotors, one rotor is coupled to the vane with the other rotor being coupled to the housing for relative angular positioning between the pair of rotors.

In yet another embodiment of the invention a servo valve controls the flow between the first inlet and the second outlet, and the second inlet and the first outlet. A pressure imbalance created by the controlled flow can force the vane to move angularly with respect to the rotating housing to achieve the desired adjustment.

Other objects and advantages will become apparent from the following specification taken in connection with the accompanying drawings.

DESCRIPTION OF THE PREFERRED EMBODIMENT

Figure 1:
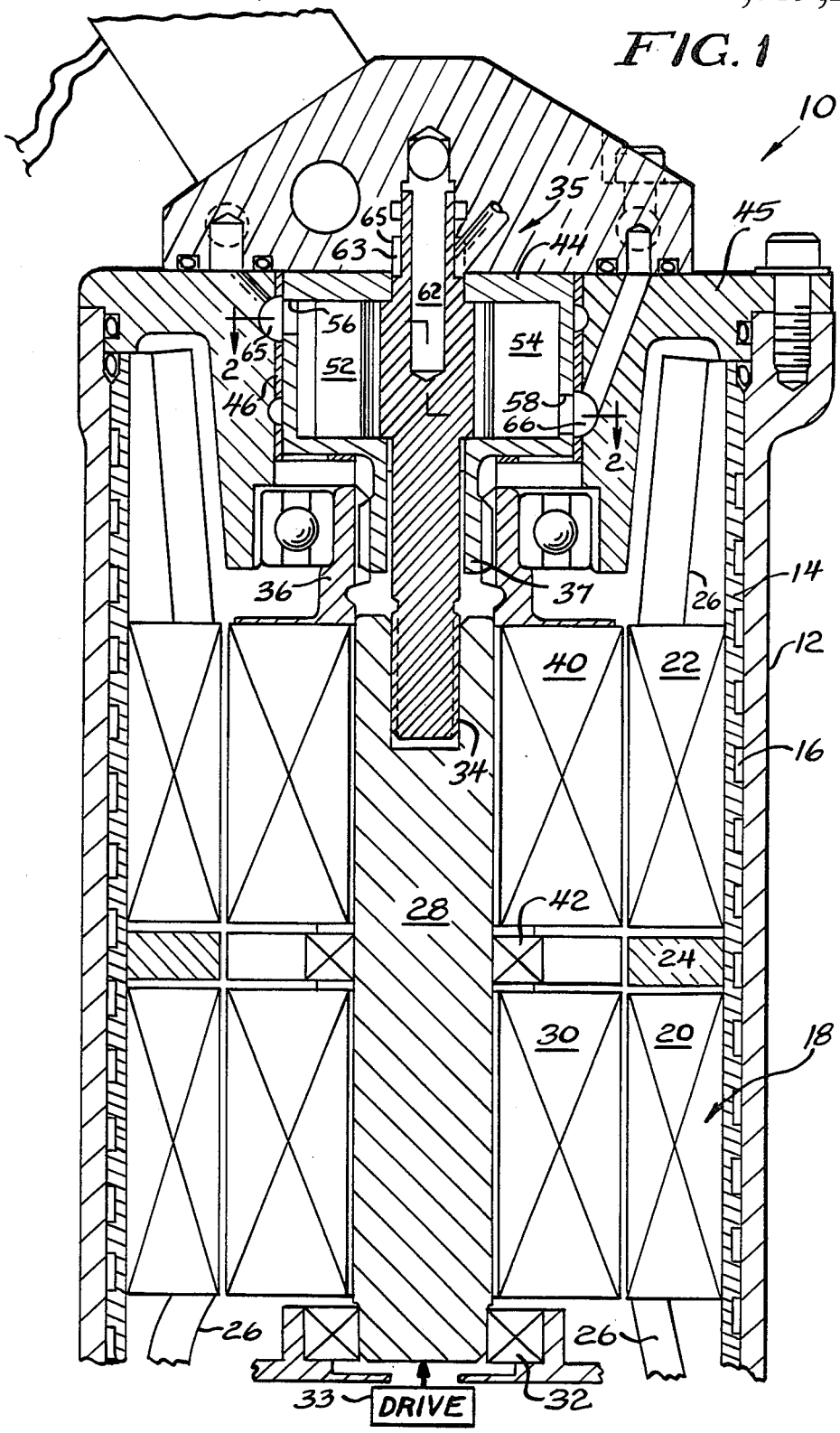
FIG. 1 is a sectional view of a dual permanent magnet generator incorporating the rotary actuator of the present invention.

An exemplary embodiment of an actuator made according to the invention is illustrated in the drawings and with reference to FIG. 1 is shown in conjunction with a dual permanent magnet generator (PMG) 10.

The PMG 10 includes an elongated, generally tubular housing 12. An inner jacket 14 includes a spiral groove 16 with the housing 12 serving to close the groove 16 so as to provide a conduit for so-called back-iron cooling.

Radially inwardly of the jacket 14 is a stator 18. The stator 18 is comprised of first and second armatures 20 and 22. The armatures 20 and 22 are coaxial and slightly spaced apart by a support element 24. A common set of windings, the end turns 26 of which can be seen, extends through both of the armatures 20 and 22.

An elongated inner shaft 28 extends longitudinally through the housing 10 along the elongated axis thereof and rotationally supports and is affixed to a first permanent magnet rotor assembly 30. One end of the inner shaft 28 is journaled in bearings 32 and may be coupled to a drive 33 such as an aircraft engine. Its other end is splined to an actuator output shaft 34. The actuator output shaft 34 forms part of a rotary actuator 35 which will be discussed in greater detail below.

An outer shaft 36 is concentric with respect to the inner shaft 28 and is positioned near the actuator shaft 34. The outer shaft 36 rotationally supports and is affixed to a second permanent magnet rotor assembly 40.

A bearing 42 provides for relatively frictionless relative angular movement between the permanent magnet assemblies 30 and 40 about the axis of the shafts 28 and 36 and additionally provides a journal therefor.

The outer shaft 36 is splined to a second actuator output shaft 37 which is part of an actuator housing 44. A journal bearing 46 supports the actuator housing 44 for rotation about the axis of the shafts 28 and 36 mounted within an end cap 45 for the housing 12.

The operation of the rotary actuator 35 is best illustrated with reference to both FIG. 1 and FIG. 2.

The housing 44 includes an internal partition 47 defining a chamber 48 therein for receiving a hydraulic fluid. The chamber 48 has the shape of a section of a cylinder. The actuator shaft 34 carries a vane 49 within the chamber 48 which is also rotatable about the axis of the shaft 28 and seals against both the partition 47 and the walls defining the chamber 48. The vane 49 and the partition 47 divide the chamber 48 into first and second compartments 52 and 54 of variable volume. The volume of each compartment 52 and 54 is determined by the relative angular position of the vane 49 within the housing 44 with respect to the partition 47.

The housing 44 includes first and second, radially outer outlet ports 56 and 58, one for each compartment 52 and 54 respectively. Each of the compartments 52 and 54 further includes a radially inner inlet port 60 and 61 respectively. For the first compartment 52 the hydraulic fluid enters by way of intersecting bores 62 which extends through the actuator shaft 34 and the vane 49 opening to the inlet port 60. Fluid entry means for the second compartment 54 includes an annulus 63, formed by a step on the actuator shaft 34, which then opens through a passage, not shown, formed in the actuator shaft 34 and thereafter into the second inlet port 61.

The fluid exiting outlet port 56 is collected in an annular recess 65 in the end cap 45. Similarly, the fluid exiting outlet port 58 is collected in a further annular recess 66, also in the end cap 45. The journal bearing 46 provides a seal between the annular recesses 65 and 66, and thus the outlet ports 56 and 58.

The vane 49 is rotatable through a 180° arc (although a greater or lesser range of angular movement could be utilized in various instances), and is illustrated at a position wherein the first and the second compartments 52 and 54 are of generally equal volume. When fluid pressure in the second compartment 54 exceeds fluid pressure in the first compartment 52, the vane 49 rotates in a clockwise direction causing the volume of the second compartment 54 to increase and the volume of the first compartment 52 to decrease. Consequently, the resultant relative angular position of the vane 49 with respect to the housing 44 changes. A similar but opposite result occurs when the fluid pressure in the first compartment 52 exceeds the fluid pressure in the second compartment 54.

Figure 3:
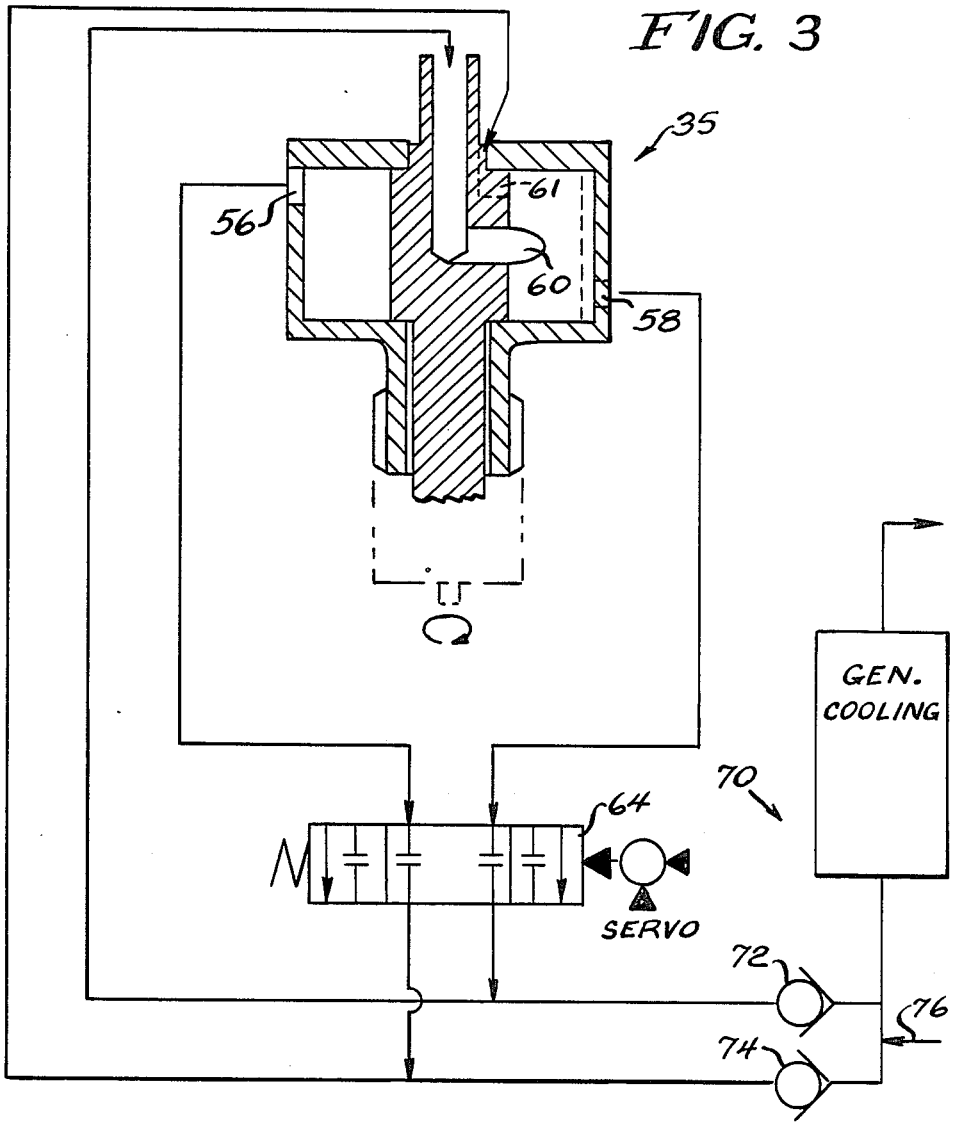
FIG. 3 illustrates a hydraulic system including a sectional view of the actuator of FIG. 1 with accompanying devices shown in schematic form.

With reference now to FIG. 3 a hydraulic schematic of a system including the actuator of the present invention is illustrated.

It will be recalled that the drive 33 is coupled to the shaft 28 for imparting rotation to the shaft 28, and ultimately, the housing 44. A pressure head is developed by centrifugal force at the outlet ports 58 and 56 by reason of their radially outer location when the housing 44 is rotated about its axis and tends to force hydraulic fluid out of each of the compartments 52 and 54. The fluid exiting the outlet port 56 or 58 of either compartment 52 or 54 may be directed, through its associated annular recess 65 or 66, and thereafter through a servo valve 64, into the input port 60 or 61 (whereat the pressure will be at a lower level due to the relatively radially inner position of the ports 60 and 61) of the other compartment 52 or 54 causing a pressure imbalance which will force the vane 49 to move angularly with respect to the housing 44 as described previously. The use of the centrifugal head caused by the rotation of the housing 44 provides an actuator 35 which is self-powered and does not rely on such external hydraulic components such as a pump and accumulators.

While a servo valve is shown in the figures, a manually operated valve, a hydraulically actuated valve or some other known type valve could be substituted for the servo valve as would be known in the art.

The servo valve 64 is operated in a controlled manner, which control is not part of this invention, to effectively control fluid flow and thereby the relative angular position of the rotary vane 50 and the housing 44. In particular, the valve 64 can be positioned as illustrated in FIG. 3 to halt flow of hydraulic fluid from either port 56 or 58, be shifted to the left from the position illustrated in FIG. 3 to connect the outlet port 58 to the inlet port 60, or be shifted to the right from the position illustrated in FIG. 3 to connect the outlet port 56 to the inlet port 61.

In the case of the first mentioned condition, the position of the vane 49 within the housing 44 will be maintained constant due to the relative incompressibility of hydraulic fluid in the two compartments 52 and 54. In the case of the second condition, the vane 49 will rotate within the housing in a counterclockwise direction as viewed in FIG. 2. Relatively high pressure fluid will exit the port 58 to be directed into the port 60. In other words, high pressure fluid at a radially outer location in the compartment 54 will be directed to the compartment 52 at a radially inner location. Consequently, the pressure of the fluid acting on the side of the vane 49 facing the compartment 52 will be greater than that in the compartment 54 causing the aforementioned counterclockwise rotation.

Figure 2:
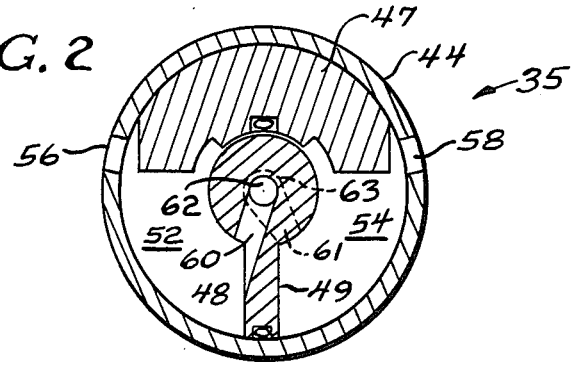
FIG. 2 is a fragmentary sectional view taken along line 2—2 of FIG. 1.

In the case of the third mentioned condition, that is, where the outlet port 56 is connected by the valve 64 to the inlet port 61, the vane 49 will rotate in the clockwise direction as viewed in FIG. 2 by essentially the same sequence just stated, reversing the ports and compartments involved.

In either case where the vane 49 moves within the housing 44, such movement will continue until the vane 49 abuts the partition 47 or until the valve 64 is returned to the position illustrated in FIG. 3, whichever occurs first. Because these factors limit relative rotation between the vane 49 and the housing 44, it will be appreciated that operation of the drive 33, which is coupled to the vane 49 via the shaft 28 and the actuator shaft 34, will always cause the housing 44 to rotate during generator operation to generate the requisite pressure head necessary to achieve control.

Desirably, a hydraulic fluid makeup supply, generally designated 70, is provided. The same may comprise first and second check valves 72 and 74 connected to the inlet ports 60 and 61, respectively, and to a source of hydraulic fluid under pressure as schematically shown at 76. The check valves have the orientation shown and are accordingly operative to allow fluid to flow to either compartment within the housing 44 when additional fluid is required but prevent backflow during operation of the generator.

Again referring to FIG. 1, when the first rotor 30 is coupled to the rotary vane 34 and the second rotor 40 is coupled to the housing 44 the relative angular alignment of the vane 49 with respect to the housing 44 is reflected in similar angular alignment between the first and the second rotors 30 and 40. Consequently, angular movement of the vane 49 caused by a pressure imbalance in the compartments 52 and 54 changes the relative angular alignment of the rotors 30 and 40 in the dual PMG 10 to thereby regulate the output voltage of the dual PMG 10.

While the embodiment disclosed is that of a dual permanent magnet generator the applicant does not intend that the application of this invention be limited to usage in conjunction with a permanent magnet generator. For example, this invention could be utilized in a transmission for gear shifting. Other systems where such an actuator could be employed are known in the art and will therefore not be discussed herein.

Furthermore, the present invention might be employed in an application where the respective loads are coaxial, as described hereinabove, are positioned in a side-by-side relationship or are positioned in some other relationship. Necessary coupling means to render such alternate applications feasible for use with the actuator of the present invention are known in the art. Likewise, in a device having coaxial loads the actuator of the present invention could also be positioned between the respective loads with the two actuator output shafts protruding at opposite ends of the actuator housing rather than in a telescoping configuration as shown in the figures.

Similarly, the principles utilized in this invention could also be applied to a non-rotary type actuator, such as a piston operated actuator, to provide a self-powered non-rotary actuator.

I claim:

1. A self-powered actuator comprising:

a housing;

means mounting said housing for rotation about an axis;

a chamber within said housing;

a divider mounted in said chamber for movement therein and dividing said chamber into first and second variable volume compartments;

an actuator element coupled to said divider to be moved thereby and including means for coupling said divider to a load;

first and second inlets respectively for said first and second compartments;

first and second outlets respectively for said first and second compartments; and means including at least one fluid flow control device connecting said first inlet to said second outlet and said second inlet to said first outlet;

whereby fluid in said compartments will develop a pressure head through centrifugal force to power said actuator when said housing is rotated about said axis.

2. The actuator of claim 1 wherein the fluid flow control device is a valve.

3. A self-powered rotary actuator comprising:

a housing;

means mounting said housing for rotation about an axis; .

a chamber within said housing;

a vane mounted in said chamber for rotation therein about said axis and dividing said chamber into first and second variable volume compartments;

an actuator element coupled to said vane to be moved thereby and including means for coupling said vane to a load;

first and second inlets respectively for said first and second compartments;

first and second outlets respectively for said first and second compartments; and means including at least one fluid flow control device connecting said first inlet to said second outlet and said second inlet to said first outlet;

whereby fluid in said compartments will develop a pressure head through centrifugal force to power said actuator when said housing is rotated about said axis.

4. The actuator of claim 3 further comprising a second actuator element coupled to said housing to be moved thereby and including means for coupling said housing to a second load.

5. The actuator of claim 4 wherein the actuator elements include concentrically mounted shafts and the actuator provides relative angular alignment of the loads driven by the concentrically mounted shafts.

6. The rotary actuator of claim 3 wherein the fluid flow control device is a valve.

7. The rotary actuator of claim 3 wherein said first inlet comprises intersecting bores extending through said actuator element and said vane opening into said first compartment and said second inlet comprises an annulus formed by a step on said actuator element and a passage in said actuator element, which opens into said second compartment.

8. A self-powered hydraulic rotary actuator comprising:

a housing;

means mounting said housing for rotation about an axis;

a fluid chamber within said housing;

a rotary vane mounted in said fluid chamber for rotation therein about said axis and dividing said fluid chamber into variable volume compartments, with the volume of each compartment determined by the relative angular position of the rotary vane with respect to the housing;

a first actuator element coupled to said vane to be moved thereby and including means for coupling said vane to a first load;

a second actuator element coupled to said housing to be moved thereby and including means for coupling said housing to a second load;

first and second inlets respectively for said first and second compartments;

first and second outlets respectively for said first and second compartments; and means including at least one fluid flow control device connecting said first inlet to said second outlet and said second inlet to said first outlet;

whereby fluid in said compartments will develop a pressure head through centrifugal force to power said actuators when said housing is rotated about said axis.

9. The rotary hydraulic actuator of claim 9 wherein the first and second actuator elements are concentric shafts and relative rotation of the rotary vane with respect to the housing provides relative angular alignment of the first and second loads driven by the concentrically mounted shafts.

10. The rotary hydraulic actuator of claim 9 wherein the flow control device is a valve.

* * * * *